United States Patent [19]

Silberman et al.

[11] 4,369,966

[45] Jan. 25, 1983

[54] FOLDING EXERCISING APPARATUS

[75] Inventors: Ira J. Silberman; Calvin E. James, Sr., both of Opelika, Ala.

[73] Assignee: Diversified Products Corporation, Opelika, Ala.

[21] Appl. No.: 128,084

[22] Filed: Mar. 7, 1980

Related U.S. Application Data

[63] Continuation-in-part of Ser. No. 12,487, Feb. 15, 1979, Pat. No. 4,316,609.

[51] Int. Cl.[3] ..... A63B 21/00

[52] U.S. Cl. ..... 272/62; 272/123; 272/117; 272/145

[58] Field of Search ..... 272/117, 62, 118, 134, 272/144, 145, 93, 122, 123

[56] References Cited

U.S. PATENT DOCUMENTS

| | | | |
|---|---|---|---|
| Re. 26,606 | 6/1969 | Dodge | 272/62 |
| 321,388 | 6/1885 | Ruebsam | 272/118 |
| 382,440 | 5/1888 | Sanchez | 272/118 |
| 482,028 | 9/1892 | Teufel | 5/138 |
| 1,582,487 | 4/1926 | Shank | 272/134 |
| 1,928,089 | 9/1933 | Blickman | 272/78 |
| 2,632,645 | 3/1953 | Bakashat | 272/145 |
| 2,855,200 | 10/1958 | Blickman | 272/131 |
| 2,977,120 | 3/1961 | Morris | 272/118 |
| 3,005,633 | 10/1961 | Riemer | 272/144 |
| 3,010,720 | 11/1979 | Allard | 272/117 |
| 3,103,357 | 9/1963 | Berne | 272/130 |
| 3,268,224 | 8/1966 | Freshour | 272/117 |
| 3,307,534 | 3/1967 | Gibbs | 272/25 |
| 3,316,609 | 2/1982 | Silberman | 272/118 |
| 3,342,485 | 9/1967 | Gaul | 272/145 |
| 3,614,097 | 10/1971 | Blickman | 272/72 |
| 3,625,511 | 12/1969 | Rennemann | 272/122 |
| 3,640,528 | 2/1972 | Proctor | 272/118 |
| 3,734,495 | 5/1973 | Nist | 272/118 |
| 3,770,267 | 11/1973 | McCarthy | 272/134 |
| 3,850,431 | 11/1974 | Winans | 272/118 |
| 3,918,710 | 11/1975 | Niebojewski | 272/117 |
| 3,948,513 | 4/1976 | Pfotenhauer | 272/62 |
| 4,010,947 | 3/1977 | Lambert | 272/118 |
| 4,026,545 | 5/1977 | Schoenberger | 272/73 |
| 4,046,373 | 9/1977 | Kim | 272/63 |
| 4,068,843 | 1/1978 | Frost | 272/118 |
| 4,098,509 | 7/1978 | Faust | 272/122 |
| 4,257,590 | 3/1981 | Sullivan | 272/117 |

OTHER PUBLICATIONS

1978 Best Products Catalog Cover, pp. 364, 365 (9/1977 eff date).

J. C. Penny Catalog for Fall & Winter 1977, Cover and p. 733.

Marcy Gymnasium Equipment Catalog, 12/1968 Glendale, CA.

*Primary Examiner*—Richard J. Johnson

*Attorney, Agent, or Firm*—Schuyler, Banner, Birch, McKie and Beckett

[57] ABSTRACT

A simple and versatile folding exercising apparatus which enables the user to perform a wide variety of weight training exercises. The apparatus includes an upstanding frame and a bench pivoted to the frame for movement between a laterally extended use position and an upright, compact storage position juxtaposed with the frame. The apparatus includes barbell support cradles, a rope and pulley weight pull device, a lat bar device with squat rack and chinning bar, and readily detachable devices for performing curling, sit-ups, leg lifts and head lifts.

7 Claims, 14 Drawing Figures

FIG. 1.
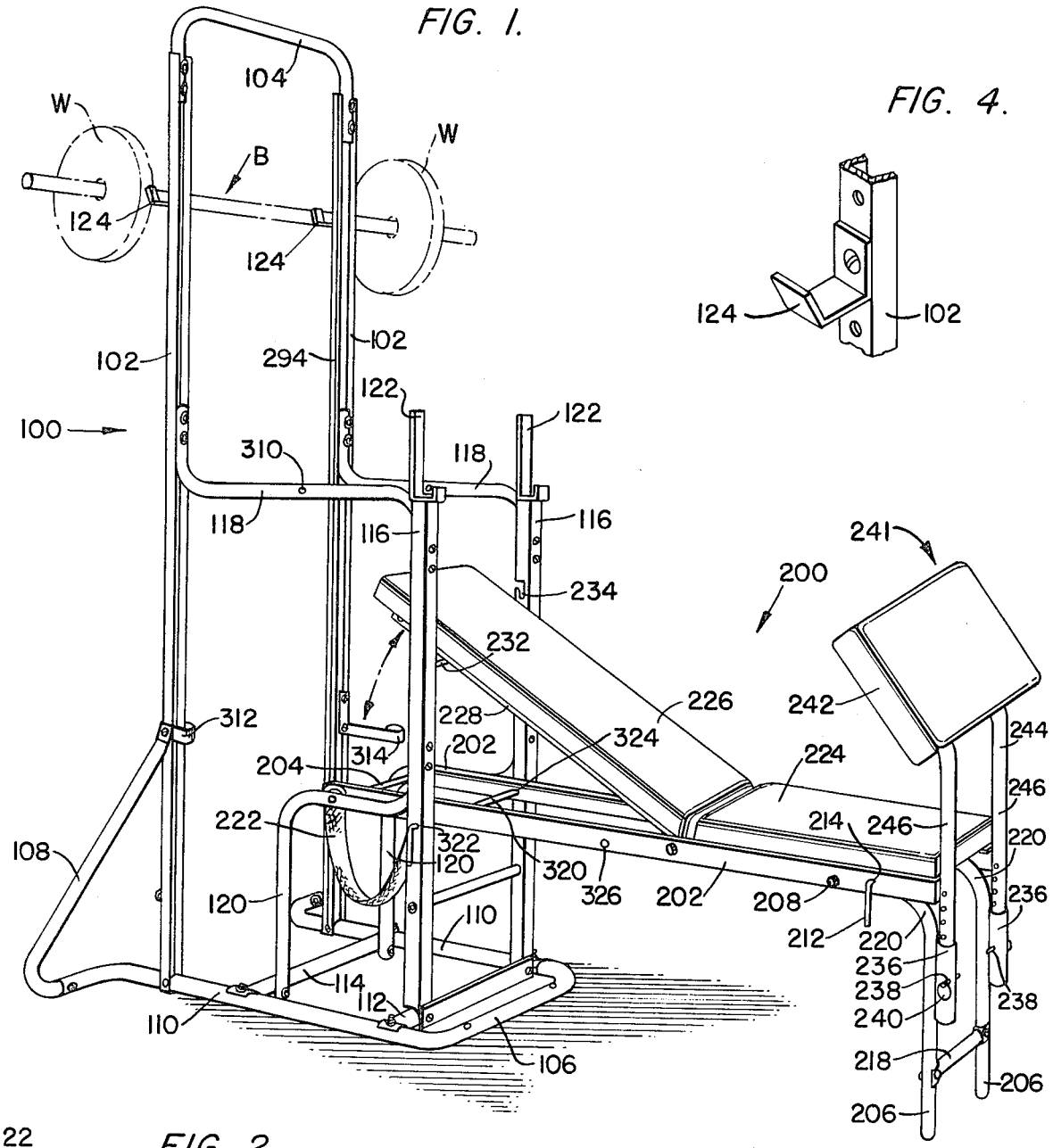
FIG. 4.
FIG. 2.
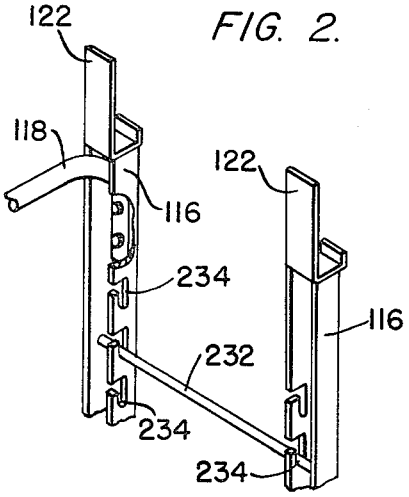
FIG. 3.
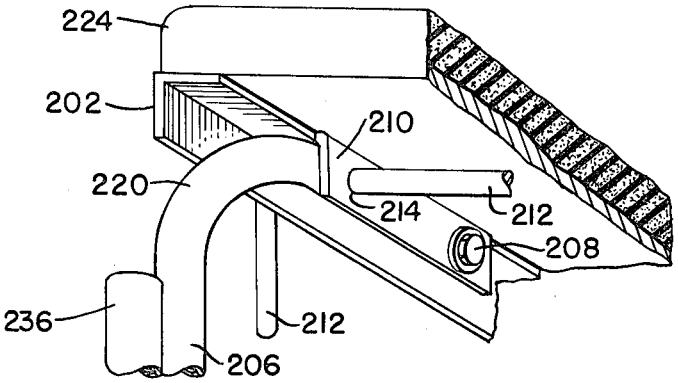

FOLDING EXERCISING APPARATUS

RELATED APPLICATION

This application is a continuation-in-part of copending application Ser. No. 12,487, filed Feb. 15, 1979 now U.S. Pat. No. 4,316,609.

BACKGROUND OF THE INVENTION

1. Field of the Invention

The present invention relates to exercising devices for developing and conditioning various parts of the body and, more particularly, to an exercising apparatus which can be folded into a compact unit for storage.

2. Description of the Prior Art

The importance of regular exercise for building and maintaining strength and endurance cannot be overemphasized. The modern conveniences which we enjoy and the sedentary tasks which we increasingly perform have given us a comfortable lifestyle at the expense of physical fitness. Highly active exercise programs, such as running, develop endurance of the cardiovascular system. Muscular strength and endurance is best developed through weight training.

The simplest and least expensive apparatus for weight training is the barbell with removable weights. However, the use of a barbell alone cannot develop all areas of the body. Hence, additional apparatus must be employed for a comprehensive conditioning program. Devices developed for this purpose generally provide the user with a force register against which muscular effort must be applied. Resistance is typically provided by means of a weight and pulley arrangement, or an elastic element. These devices permit the force to be applied to the user's body from many different directions in order to develop substantially all areas of the body.

Few of these weight training devices, however, can provide the user with substantially all of the exercising variants required to develop the entire body. Those that do are generally large, complex and costly machines which occupy a substantial amount of space, cannot be used with a common barbell set and consequently are not suitable for home use. These are usually found only at health clubs and other athletic estblishments. More specialized devices for developing limited areas of the body are available, but a number of different devices of this type must be used in order to provide a complete range of exercises.

SUMMARY OF THE INVENTION

Accordingly, it is an object of the present invention to obviate the above-noted disadvantages of the prior art by providing a simple, compact and inexpensive exercising apparatus for performing a complete range of weight training exercises.

Another object of the invention is to provide such an apparatus which is self-supporting yet strong, stable and relatively compact.

Another object of the invention is to provide such an apparatus which is foldable into a compact unit for storage.

Another object of the invention is to provide such an apparatus having some components which may be used independently of or interchangeably with others.

Another object of the invention is to provide such an apparatus which is used in conjunction with a simple and inexpensive barbell set for providing the desired exercises.

Another object of the invention is to provide such an apparatus which is designed to be shipped in separate cartons of manageable size, and assembled by the consumer.

Another object of the invention is to provide such an apparatus having adjustable components which may be adjusted to suit the needs of various users.

In copending application Ser. No. 12,487, filed Feb. 15, 1979, an exercising apparatus is disclosed which comprises, in combination, a bench with barbell support tubes and weight pull and lat bar devices attached to the head end of the bench for performing a complete range of exercises. The present invention is a modification of the exercising apparatus disclosed in the earlier filed copending application.

The above and other objects of the present invention are accomplished by providing an exercising apparatus comprising a floor-supported chinning bar assembly having upstanding frame means including an overhead bar, and an exercising bench having an elongated bench frame and a seat supported on the bench frame, the bench frame being pivotally attached near one of its ends to the frame means for pivotal movement between a laterally extended use position for supporting a user on the seat, and an upright, compact storage position juxtaposed with the frame means.

Bench locking means may be provided for preventing pivotal movement of the bench relative to the frame means when the bench is in either its use position or its storage position. The bench frame is provided with legs at its unpivoted or free end, and the legs are foldable between a first extended position to support the bench in a substantially level attitude, and a second folded position to support the bench at an incline with its unpivoted end lower than its pivoted end. Leg locking means may be provided for locking the legs in their extended positions.

The invention also includes a weight pull exercising device having a pair of upstanding, spaced guide posts, a weight pull assembly slidably guided along the guide posts, a tension element connected to the weight assembly and pulley means supported above the weight assembly for guiding the tension element, wherein the mutually facing surfaces of each of the guide posts are provided with a longitudinally extending guide track, the weight assembly has complementary side surfaces which mate with the guide tracks, and the weight assembly includes spring means for resiliently outwardly biasing the side surfaces of the weight assembly into positive sliding engagement with the guide tracks. The side surfaces of the weight assembly are preferably formed of a low friction material. The weight assembly may comprise a transverse tubular member having a low friction material piston received in each of its ends, with a compression spring between the pistons to bias the pistons outwardly into engagement with the guide tracks.

BRIEF DESCRIPTION OF THE DRAWINGS

The novel features of the invention are set out with paticularity in the appended claims, but the invention will be understood more fully and clearly from the following detailed description of the invention as set forth in the accompanying drawings, in which:

FIG. 1 is a perspective view of the exercising apparatus according to the invention, but with the weight assembly, pulley and tension element removed for the sake of clarity;

FIG. 2 is a detail view, partly in section, of the barbell support posts of the apparatus and the mechanism for supporting the incline seat portion of the bench;

FIG. 3 is a detail view of the interconnection of one of the foldable legs of the bench with the bench frame, and the cooperating locking means;

FIG. 4 is a detail view of a portion of the upstanding frame means showing one of a pair of barbell cradles which enable the apparatus to function as a squat rack;

DESCRIPTION OF THE INVENTION

Figure 5:
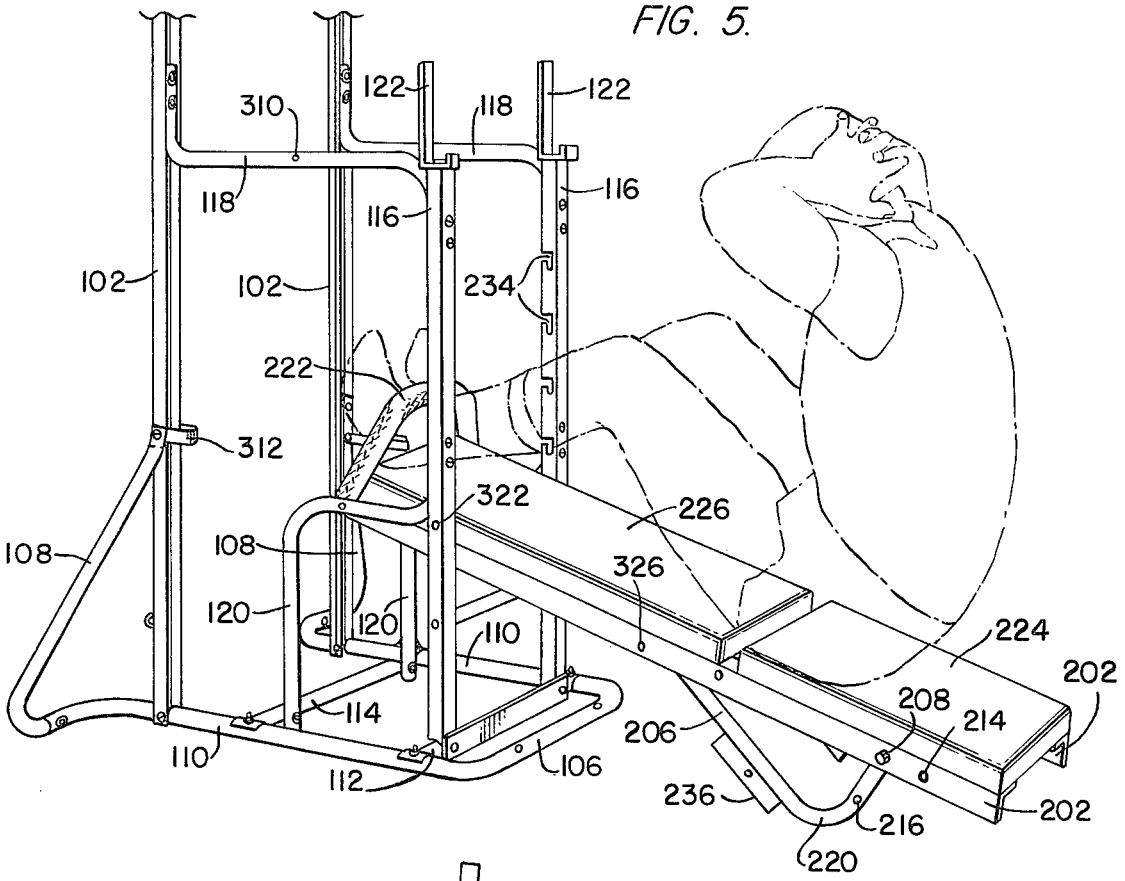
FIG. 5 is a partial perspective view of the apparatus showing the entire bench in an inclined attitude for use as a slant board sit-up device.

In the preferred embodiment shown in the figures, most of the structural elements of the invention are tubular or channel-shaped steel members which are secured together by bolted connections. Of course, other types of members of various cross-section may be used, and they may be secured together by other means, such as welding.

Referring to FIG. 1, the apparatus according to the invention includes an upstanding chinning bar, squat rack and weight pull frame 100 comprising two spaced, parallel, upstanding guide posts 102 secured together at their upper ends by an inverted U-shaped tubular overhead bar 104, and at their lower ends by a tubular perimeter base member 106, and stabilized by lateral oblique stabilizer struts 108. The parallel legs 110 of base perimenter member 106 are spanned by a front tubular strut 112 and a rear tubular strut 114. Upstanding barbell support posts 116 are bolted to strut 112, and are stabilized at their upper ends by top side members 118 secured to guide posts 102. Lower side members 120 interconnect barbell support posts 116 with strut 114. Barbell support posts 116 terminate at their upper ends in barbell rest cradles 122. A pair of squat rack barbell rest cradles 124 are adjustably bolted to guide posts 102 (see FIG. 4). Cradles 122 and 124 serve as supports for a barbell B having weights W during the course of performing various exercises. The arrangement of elements of the weight pull frame 100 results in a very strong, rigid and stable structure.

An exercising bench 200 is supported on frame 100 between barbell support posts 116. Bench 200 comprises a pair of L-shaped side rails 202 which are pivotally attached to a rod 204 interconnecting lower side members 120. The unpivoted or free end of the bench is supported on folding legs 206 which are pivotally attached to side rails 202 by bolted connections 208 through U-shaped sections 210 of the side rails. Legs 206 can be locked in their extended positions as shown in FIGS. 1 and 3 by a lock rod 212 received in aligned holdes 214 in side rails 202 and holes 216 (see FIG. 5) in legs 206. Legs 206 are interconnected near their tips by a strut 218. When lock rod 212 is removed from holes 214 and 216, legs 206 may be pivoted in unison about bolted connections 208 to a folded position (see FIG. 5) wherein their curved portions 220 support the free end of the bench on the floor in a slanted attitude. In this mode the bench may be used as a slant board sit-up device, with the user's ankles being held by an ankle strap 222 pivotally secured to rod 204.

Side rails 202 support a fixed seat portion 224 at the free end of the bench, and an incline seat portion 226 at the pivoted end. Each of these seat portions may comprise a vinyl-covered foam cushion which is secured to a plywood base. Other materials may also be used. The plywood base of fixed seat portion 224 is provided with flanged tubular nuts (not shown) secured in predrilled holes. The fixed seat portion 224 is secured to side rails 202 by means of bolts received in these nuts. Fixed seat portion 224 serves to rigidly brace side rails 202 in their respective positions. Incline seat portion 226 is supported on a pair of L-shaped members 228 (see FIG. 13) which are pivoted adjacent to fixed seat portion 224 on a pivot rod 230 extending between side rails 202. Incline seat portion 226 is adjustably supported at any desired angular position by a support bar 232 (see FIG. 2) which extends between pairs of vertically spaced notches 234 in the channels of barbell support posts 116.

Bench 200 may serve as a support for auxiliary exercising devices. To this end, legs 206 are provided with a pair of sockets 236 which are welded or otherwise secured to legs 206. Holes 238 are provided in sockets 236 and are adapted to be aligned with vertically spaced holes in the frames of other exercising devices inserted into the sockets 236 and secured thereto by means of ring-attached shear pins 240. One such auxiliary exercising device which may be attached to bench 200 in this manner is the upper arm supporting barbell curling device 241 illustrated in FIG. 1, which comprises a cushioned board 242 secured to a bent, U-shaped tubular frame 244 having depending, apertured legs 246.

Figure 6:
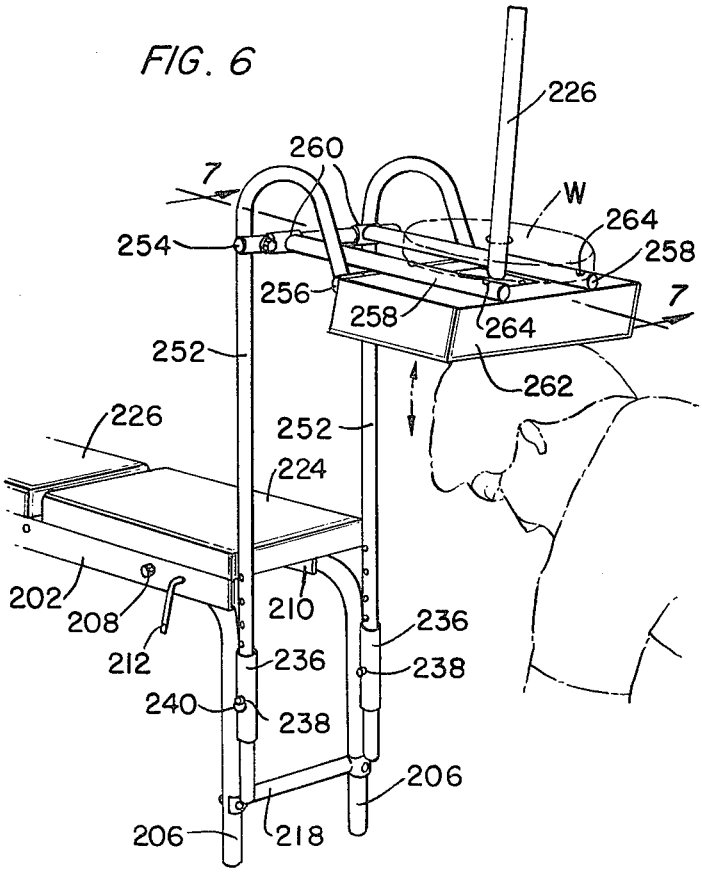
FIG. 6 is a partial perspective view of the bench showing its use in conjunction with one type of auxiliary exercising device.
Figure 7:
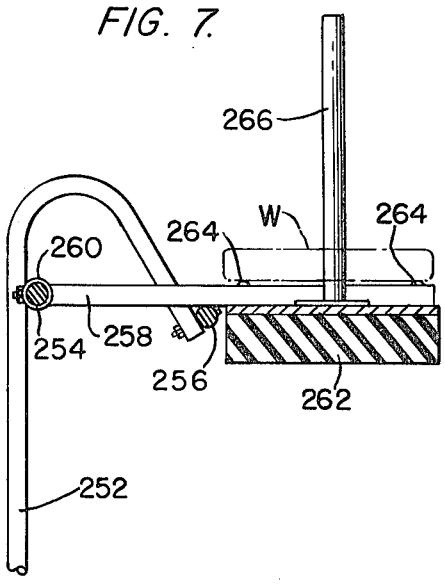
FIG. 7 is an elevational view of the exercising device of FIG. 6.

Another type of auxiliary exercising device which can be used in conjunction with bench 200 is the neck developer 250 illustrated in FIGS. 6 and 7. This device is illustrated and described in copending application Ser. No. 20,214, filed Mar. 13, 1979, and comprises a pair of inverted J-shaped members 252 which are adapted to be supported in sockets 236. A tubular crosspiece 254 is bolted across the J-shaped members 253 just beneath their curved upper portions. A tubular strut 256 is bolted across the tips of the curved portions. A pivoted weight support comprises two spaced parallel arms 258 which are pivotally mounted on crosspiece 254 by means of cylindrical collars 260 welded to the ends of arms 258. The free ends of arms 258 are secured to a padded board 262 by means of screws 264. Board 262 may comprise a plywood base having a lower padded surface of vinyl-wrapped polyurethane foam. Conventional flanged tubular nuts (not shown) are secured in predrilled holes in the plywood base and are engaged by screws 264 to secure board 262 to the arms 258. Selected weights W are retained on the weight support by an upright post 266 secured to the upper side of board 262. Strut 256 acts as a stop to limit downward pivotal movement of the weight support. Exercises are performed by repeatedly elevating the weight support with the head.

Figure 8:
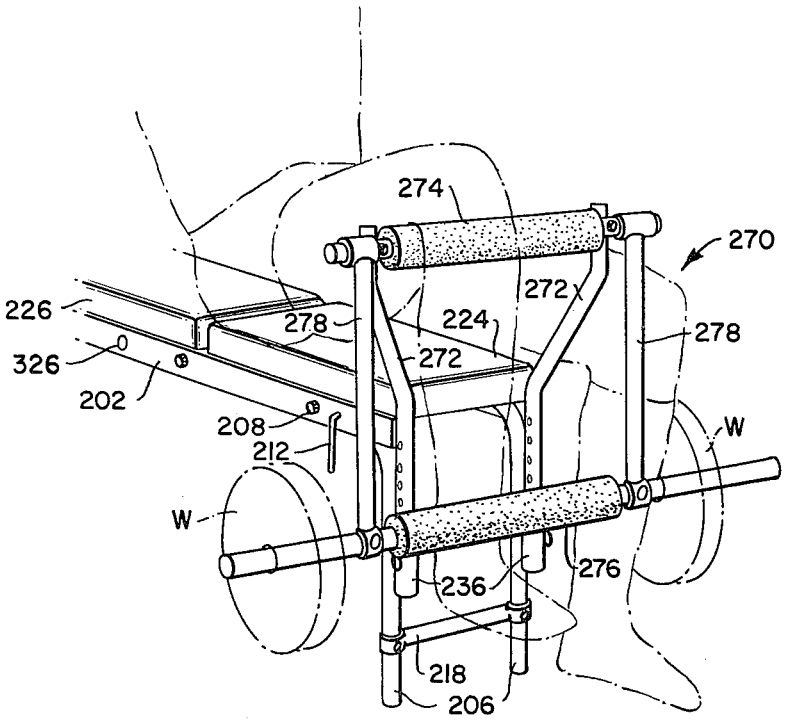
FIG. 8 is a partial perspective view of the bench showing its use with another type of auxiliary exercising device.
Figure 9:
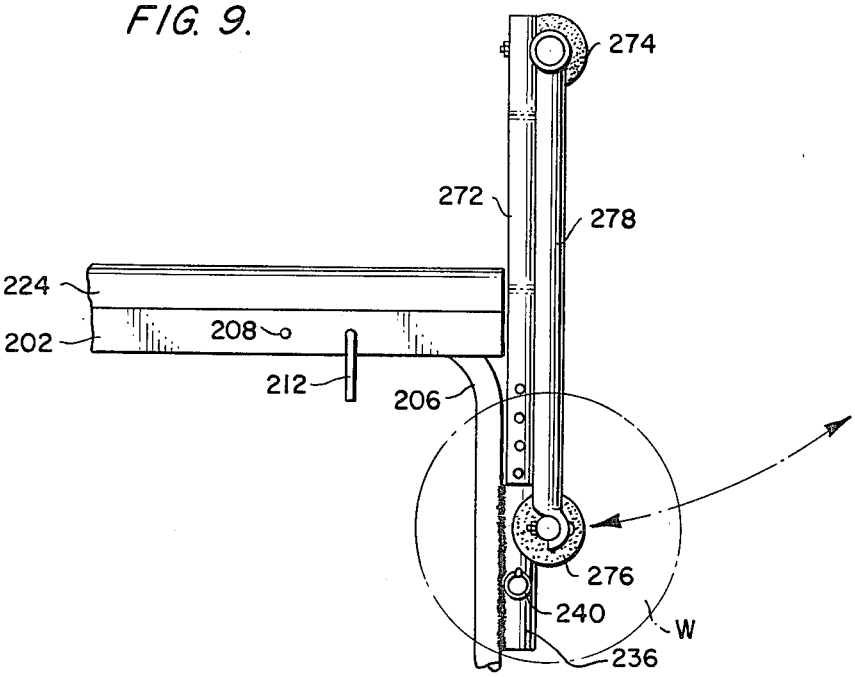
FIG. 9 is an elevational view of the exercising device of FIG. 4.

Another type of auxiliary exercising device which can be used in conjunction with bench 200 is the leg lift device 270 illustrated in FIGS. 8 and 9. This device comprises a pair of apertured tubular mounting members 272 which are adjustably received in sockets 236. Padded crossbar 274 is bolted across the tips of members 272. Any suitable padding may be used, such as a vinyl-wrapped polyurethane foam. A padded weight bar 276 is pivotally suspended from crossbar 274 by means of two struts 278 having tubular collars at their upper ends. Any desired number of weights W may be clamped to weight bar 276. Exercises are performed by repeatedly elevating weight bar 276 with the ankle.

Figure 10:
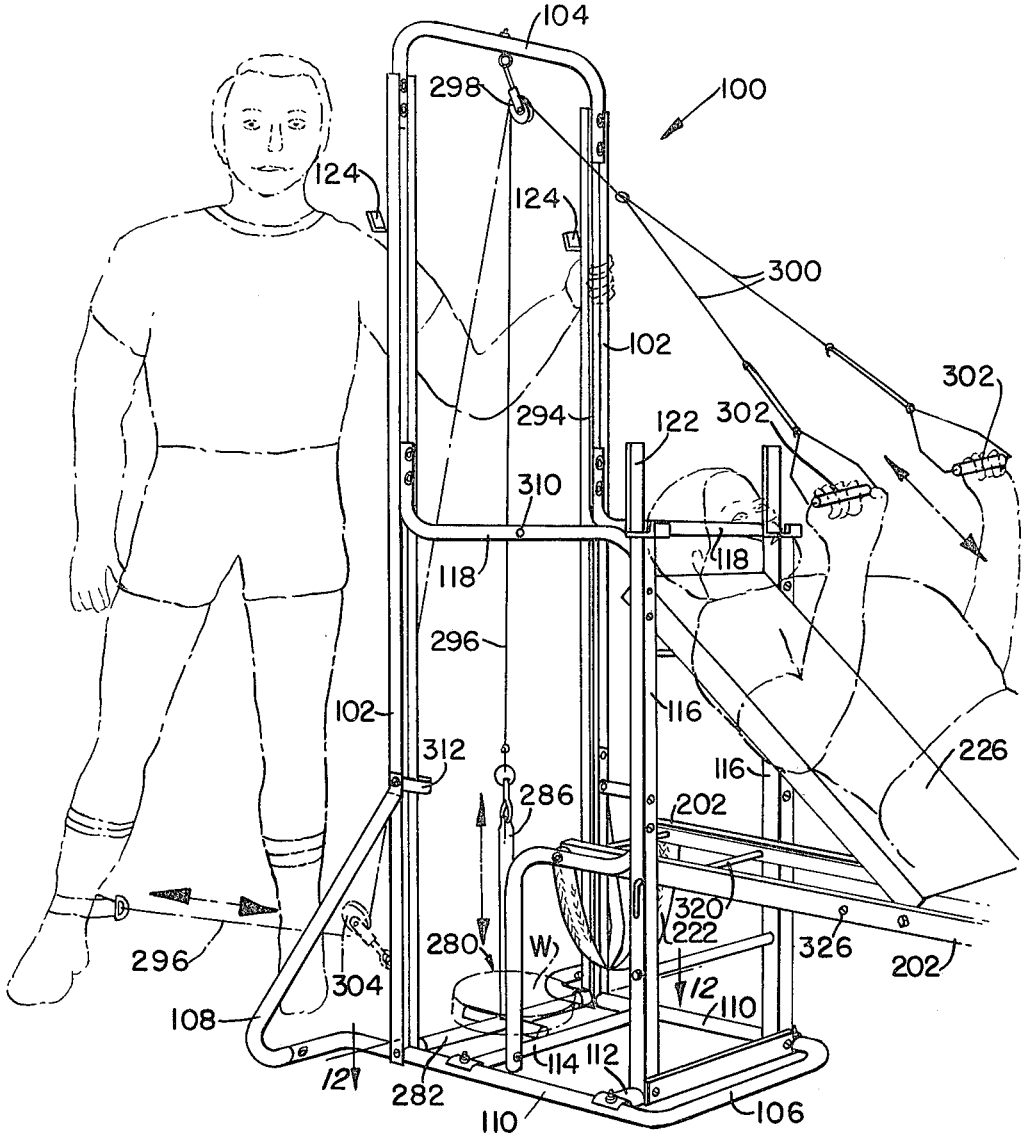
FIG. 10 is a partial perspective view of the apparatus showing the weight assembly and tension element and its flexibility in performing different types of exercises.
Figure 11:
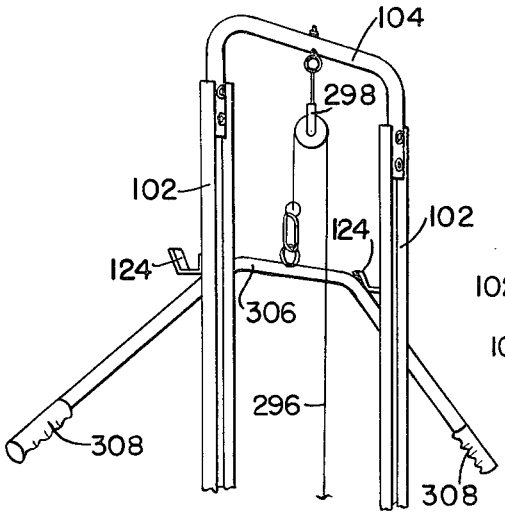
FIG. 11 is a partial perspective view of the same showing the tension element attached to a lat bar for performing lat pull exercises.
Figure 12:
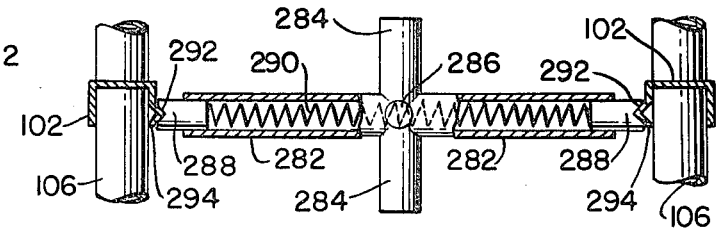
FIG. 12 is a sectional view of the weight assembly taken along line 12—12 of FIG. 10.

Referring to FIGS. 10 and 12, a weight assembly cradle 280 comprises a transverse tube 282 to which are welded stub tubes 284 and an upstanding weight rod 286. The ends of tube 282 are closed by nylon pistons 288 which are biased outwardly by compression spring 290. Pistons 288 may be formed of any other suitable low friction material, and each has a groove 292 formed therein for sliding, guided engagement with a longitudinal rail 294 formed on the mutually facing surfaces of guide posts 102. Tubes 282 and 284 support a selected number of weights W, which are lifted by the user through a rope 296 attached to weight rod 286 and trained over a pulley 298 suspended from overhead bar 104. Rope 296 branches into two separate ropes 300, each of which is provided with a handle 302 for engagement by the user. As shown in FIG. 10, weight pull devices may be performed by a user seated on bench 200, or by a user standing adjacent to the upright frame 100 by training rope 296 through a lower pulley 304. Alternatively, as shown in FIG. 11, a lat bar 306 having handles 308 may be attached to rope 296 for performing lat pull exercises. With pulley 298 removed, overhead bar 104 may be used as a chinning bar.

Figure 13:
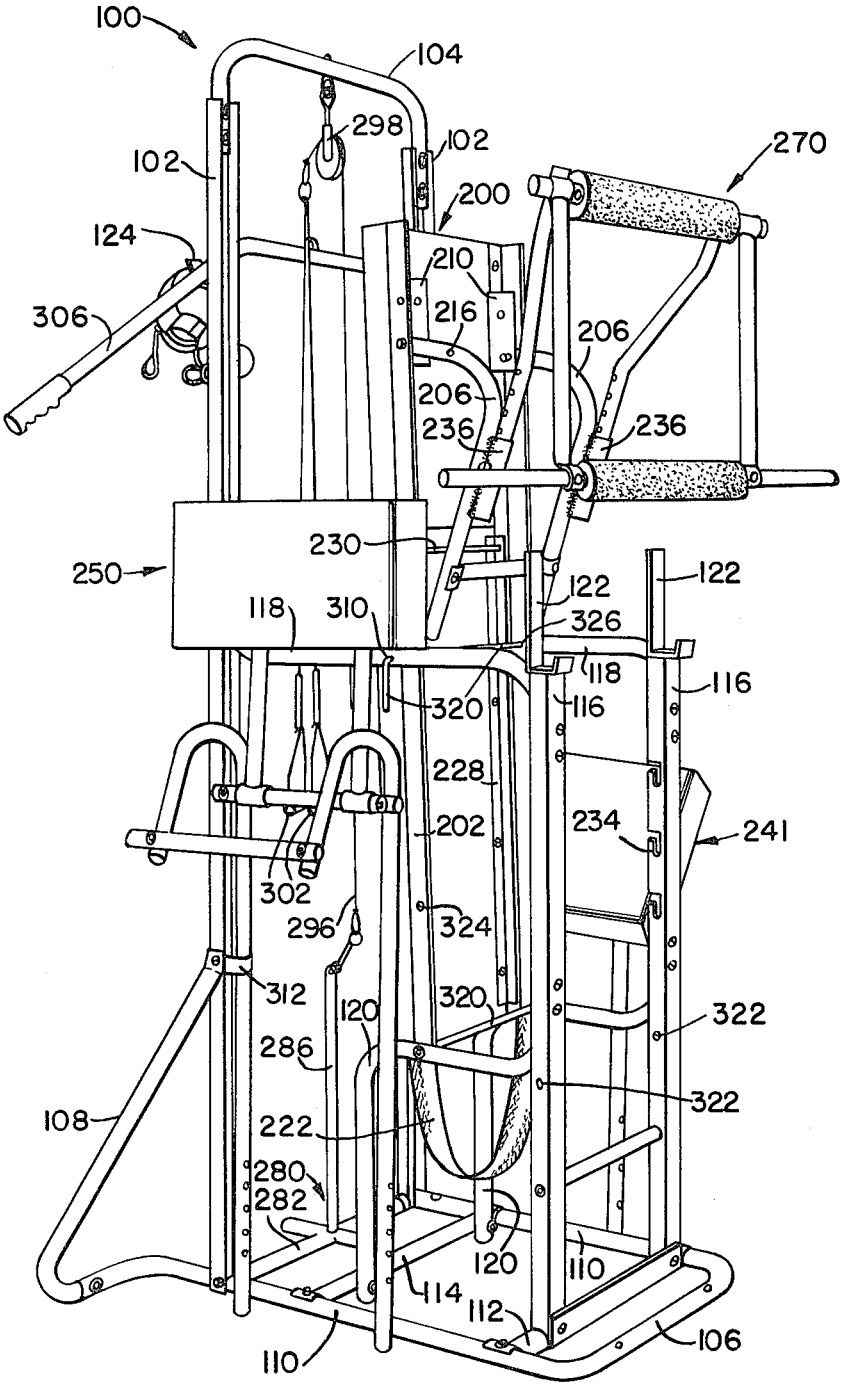
FIG. 13 is a perspective view of the entire exercising apparatus in its folded, storage position.
Figure 14:
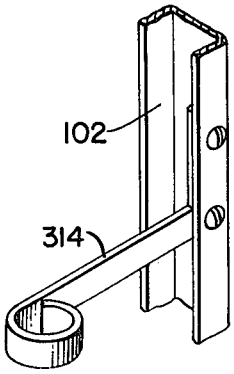
FIG. 14 is a perspective detail view of a storage bracket for holding one of the auxiliary exercising devices in a storage position.

Bench 200 is normally locked in its level position, with legs 206 extended, by a lock rod 320 inserted in aligned holes 322 in barbell support posts 116 and holes 324 in bench side rails 202. FIG. 13 illustrates the storage position of the various components of the exercising apparatus. When lock rod 320 is withdrawn from holes 322 and 324, bench 200 may be pivoted to an upright storage position and retained there by inserting lock rod 320 through aligned holes 310 in top side members 118 and holes 326 in bench side rails 202. In FIG. 13, legs 206 are shown folded and supporting in a storage position leg lift device 270. Neck developer 250 is supported for storage in a strap 312 which is bolted to one guide post 102. Barbell curling device 241 is supported for storage in a strap 314 (see FIG. 14) bolted to the other guide post 102. Lat bar 306 is stored in cradles 124.

In can be appreciated that the exercising apparatus of the invention successfully accomplishes its objectives by virtue of its simplicity, rigidity, versatility and compactness when folded for storage. It is capable of many varied uses for exercising substantially all portions of the body. It is estimated that at least 150 different exercises can be performed using this exercising apparatus.

It will be obvious to one of ordinary skill that numerous modifications may be made without departing from the true spirit and scope of the invention which is to be limited only by the appended claims.

We claim:

1. A free-standing exercising apparatus comprisng:

a floor-supported chinning bar assembly having upstanding frame means; and an exercising bench having an elongated bench frame and a seat supported on said bench frame, said bench frame being pivotally attached near one of its ends to said frame means for pivotal movement between a laterally extended use position for supporting a user on said seat and an upright, compact storage position juxtaposed with said frame means, said frame means comprising:

a bottom floor-engaging base portion adapted to stably support the apparatus without additional support above said base portion;

two upright barbell support posts flanking said bench near its pivoted end, each of said barbell support posts terminating at its upper end in a barbell rest cradle; and an overhead chinning bar rigidly supported near the upper portion of said frame means.

2. An exercising apparatus according to claim 1 wherein said bench seat is a split seat comprising a fixed portion adjacent to the unpivoted end of said bench and an adjustable incline portion hinged to said bench frame adjacent to said fixed portion, further comprising a support rod adjustably mounted along the height of said barbell support posts beneath said incline seat portion for adjustably supporting said incline portion in a desired angular position.

3. An exercising apparatus according to claim 1 further comprising bench locking means for preventing pivotal movement of said bench relative to said frame means when said bench is in either its use position or in its storage position.

4. An exercising apparatus according to claim 3 wherein said locking means comprises a locking pin engageable in aligned holes in said bench frame and said frame means.

5. An exercising apparatus according to claim 1 wherein said bench frame comprises legs at the unpivoted end of said bench which are foldable between a first extended position to support said bench in a substantially level attitude, and a second folded position to support said bench at an incline with its unpivoted end lower than its pivoted end.

6. An exercising apparatus according to claim 5 further comprising leg locking means for locking said legs in their extended positions.

7. An exercising apparatus according to claim 5 further comprising an ankle strap affixed to said bench frame and overlying said bench seat adjacent to its pivoted end for holding a user's ankles while performing sit-ups on said bench.

* * * * *